United States Patent [19]

Sobeck, Jr.

[11] 3,968,805

[45] July 13, 1976

[54] HAIR TREATMENT APPARATUS

[76] Inventor: Thomas J. Sobeck, Jr., 813-815 NE. 125 St., North Miami, Fla. 33161

[22] Filed: Sept. 8, 1975

[21] Appl. No.: 611,402

[52] U.S. Cl. ..... 132/9
[51] Int. Cl.[2] ..... A45D 19/16
[58] Field of Search ..... 132/9, 39, 38, 38 A; 150/.5; 215/1 C

[56] References Cited

UNITED STATES PATENTS

| | | | |
|---|---|---|---|
| 1,334,329 | 3/1920 | Taylor | 132/38 R |
| 1,450,930 | 8/1925 | Sullivan | 132/9 |
| 3,101,724 | 8/1963 | Nizetich | 132/9 |
| 3,198,196 | 8/1965 | Sawin | 132/9 |
| 3,800,811 | 4/1974 | Esposto | 132/9 |

FOREIGN PATENTS OR APPLICATIONS

| | | | |
|---|---|---|---|
| 227,228 | 2/1958 | Australia | 132/9 |

*Primary Examiner*—Louis G. Mancene
*Assistant Examiner*—Wenceslao J. Contreras
*Attorney, Agent, or Firm*—Oltman and Flynn

[57] ABSTRACT

The present hair treatment apparatus has a core around which strands of hair are wrapped and a flexible, fluid-tight sheath that is slipped over these strands on the core. The core is removed and the sheath is tied or clamped to the strands of hair which it encloses. The sheath has an opening with a closure cap that is removable to permit hair-treating fluid to be introduced. The core has a hair-engaging longitudinal slot at one end and a convenient finger grip at the opposite end.

14 Claims, 11 Drawing Figures

15
16
17
18
19
20
21

H
15
18
19
20

21
22
24
25
26

H
15
19
20
21
22
24
25

21
23
24
27
6
6
H

H
21
21

H
21
27
27

HAIR TREATMENT APPARATUS

BACKGROUND OF THE INVENTION

Various techniques have been used in treating human hair to change its color or appearance, such as tinting, bleaching, or stripping the hair of color. In many such treatments, the esthetic effect desired is color contrasts or highlights in the hair, with some parts treated one way, and other parts either unchanged or treated a different way. This requires careful attention to segregating different portions of the hair during such treatment, so that the fluid does not run from the portion of hair being treated in a particular way into a neighboring portion which is supposed to contrast with the portion being treated.

SUMMARY OF THE INVENTION

The present invention is directed to a novel apparatus for use in the treatment of hair to facilitate segregating a portion of hair being treated from neighboring portions of the hair.

In accordance with this invention, strands of hair are wrapped around a core, after which a flexible, fluid-tight sheath is applied over the core to enclose the wrapped-around strands of hair. Then the core is slipped out and the sheath is clamped to the strands of hair which it encloses. The sheath has an opening with a closure that is removed to enable hair-treating fluid to be introduced into the sheath for contacting the strands of hair therein. During such treatment, the sheath effectively segregates these strands of hair from neighboring portions of the hair. After the treatment time has elapsed, the sheath may be removed from the treated strands of hair.

A principal object of this invention is to provide a novel and improved apparatus which enables the convenient and effective segregation of hair that is being treated from neighboring portions of the same hair.

Further objects and advantages of this invention will be apparent from the following detailed description of two presently preferred embodiments thereof, which are shown in the accompanying drawings, in which.

Before explaining the disclosed embodiments of the present invention in detail, it is to be understood that the invention is not limited in its application to the details of the particular arrangements shown, since the invention is capable of other embodiments. Also, the terminology used herein is for the purpose of description and not of limitation.

Figures 1, 2, 3, 4, 5, 6, 7:
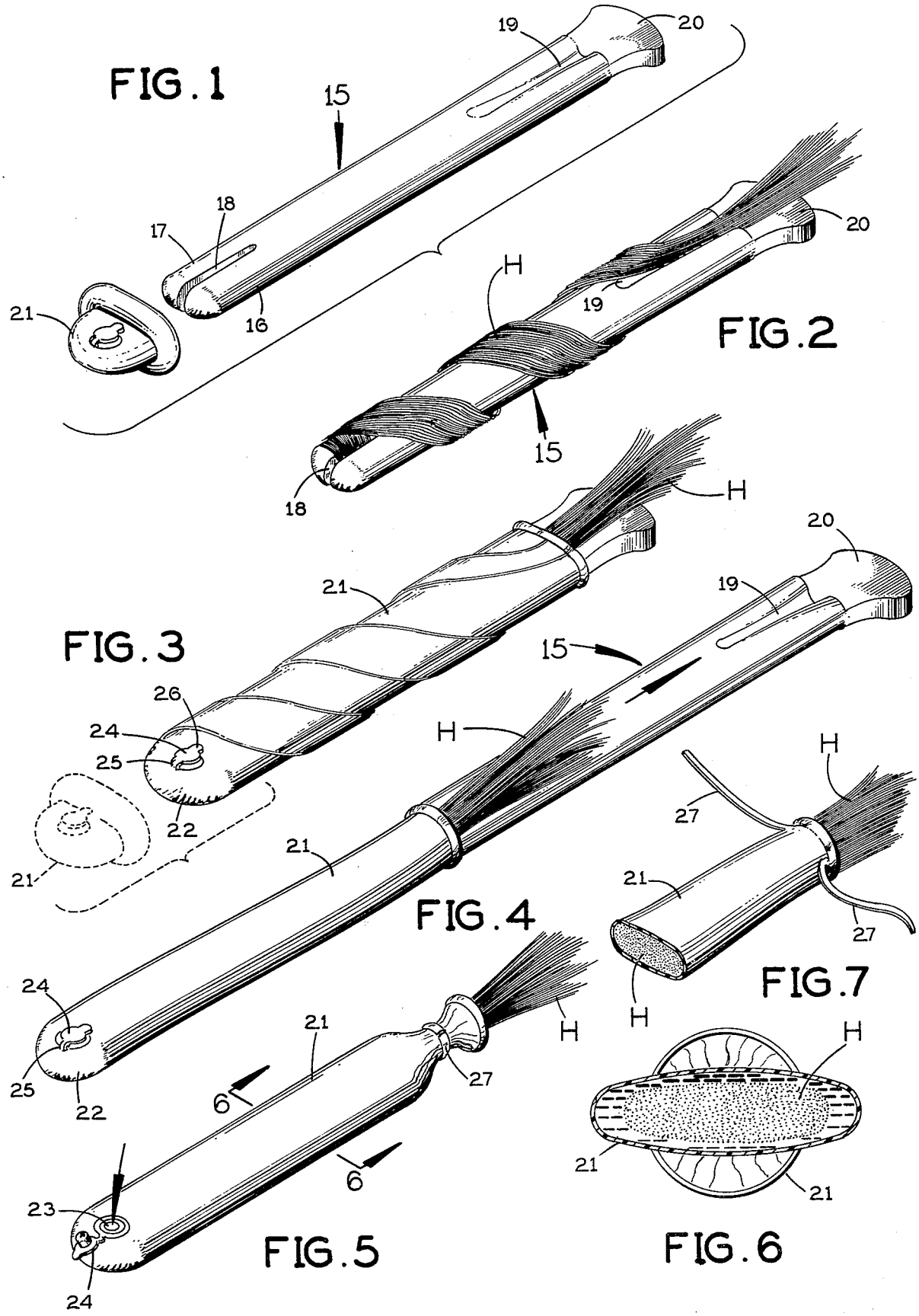
FIG. 1 is an exploded perspective view showing a first embodiment of the present apparatus before it is applied to the hair.
FIG. 2 is a perspective view showing the core of this apparatus with strands of hair wrapped around it.
FIG. 3 is a perspective view showing the apparatus after the outer sheath has been inserted over the core having the strands of hair wrapped around it, with the sheath also being shown in phantom lines in its position just before insertion over the core.
FIG. 4 shows this apparatus while the core is being removed after the sheath has been applied.
FIG. 5 shows the sheath tied to the strands of hair after the core has been removed.
FIG. 6 is a cross-section taken along the line 6—6 in FIG. 5 after hair-treating fluid has been introduced into the sheath.
FIG. 7 is a fragmentary perspective showing flexible ties on one end of the sheath.

Referring first to FIG. 1, the apparatus has an elongated, relatively slender core 15 of oblong, generally elliptical cross-section with rounded opposite edges 16 and 17. At the left end, the core is formed with a longitudinal slot 18, which is open at this end of the core and is open between the top and bottom faces of the core midway between the side edges 16 and 17.

Near its opposite end (the right end in FIG. 1), the core has a longitudinal groove 19 in its top face with a depth that increases progressively in a direction along the core away from the slot 18. Beyond the right end of this groove 19 the core has a transverse enlargement 20 with flattened top and bottom face, providing a finger grip segment for easy grasping by the thumb and forefinger.

Strands of hair H are wrapped around the core 15 as shown in FIG. 2. The free ends of these strands are inserted into the slot 18 and then the core may be rotated to wrap the hair strands helically around it, as shown. Away from their free ends the hair strands are received in the longitudinal groove 19 in the core and they pass longitudinally beyond the core to the right in FIG. 2, overlying the top of the core there.

The present apparatus also includes a flexible sheath 21 of thin, elastomeric, fluid-tight material, such as natural or synthetic rubber. Initially this sheath is rolled up, as shown in FIG. 1.

After the hair strands have been wrapped around the core 15, as shown in FIG. 2, the sheath is inserted endwise over the core at the end of the core where the slot 18 is located. Referring to FIG. 3, beginning at the phantom-line position, the sheath 21 is unrolled to the full-line position, in which it encloses the core and the wrapped-around strands of hair H for most of the length of the core. The sheath fits snugly over the core and preferably it is slightly stretched elastically, so that it retains the strands of hair in place on the core.

The sheath has a closed rounded left end 22 where it extends across and completely encloses the slotted end of the core. Near this end the sheath is formed with a circular opening 23 (FIG. 5), which normally is closed in fluid-tight fashion by a snap-on cap 24 of the same elastomeric material as the sheath. This closure cap is connected integrally to the sheath by a short, flexible web 25. The cap has a tab 26 opposite this connecting web which the user may grasp when applying the cap or removing it.

After the sheath has been applied, the core 15 may be slipped out of the sheath by sliding it longitudinally to the right (FIG. 4). The strands of hair H remain in the sheath because this longitudinal displacement of the core is in a direction tending to unwind the strands of hair from the core. Therefore, the core is readily removed, leaving the strands of hair in the sheath.

Next the sheath is clamped tightly to the strands of hair near the open end of the sheath. This tying may be effected by flexible ties 27 which are permanently attached to the body or the sheath, as shown in FIG. 7, or by a separate flexible tie or ties. The tie or ties may be of plastic or thin metal wire.

After this has been done (FIG. 5), the opening 23 may be uncovered by removing its closure cap 24, and hair-treating fluid, such as a hair bleach or hair tinting liquid, is poured into this opening. Then the cap 24 is applied to close the opening 23, and now the sheath provides a fluid-tight envelope for holding the hair-treating fluid in contact with the strands of hair in the sheath, as depicted in cross-section in FIG. 6.

At the end of the desired treatment interval, the ties 27 are released and the sheath 21 may be removed from the strands of hair.

FIGS. 8–11 show an alternative embodiment of the present apparatus which is essentially similar to that of FIGS. 1–7, except that the apparatus of FIGS. 8–11 has a much more oblong cross-sectional shape. Elements of the apparatus of FIGS. 8–11 which correspond to those in FIGS. 1–7 are given the same reference numerals, with an "a" suffix added, and the detailed description of these elements will not be repeated.

Figure 8:
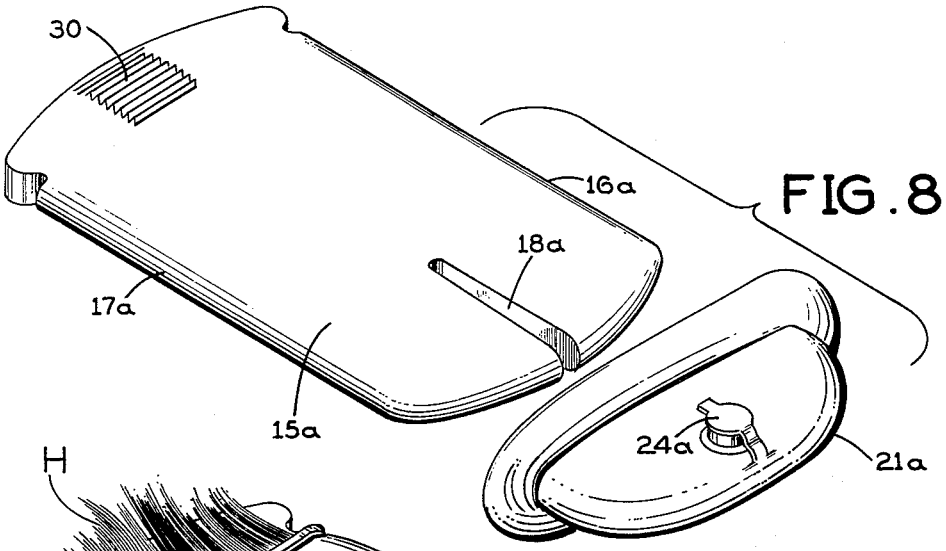
FIG. 8 is an exploded perspective view showing a second embodiment of the present apparatus before it is applied to the hair.
Figure 9:
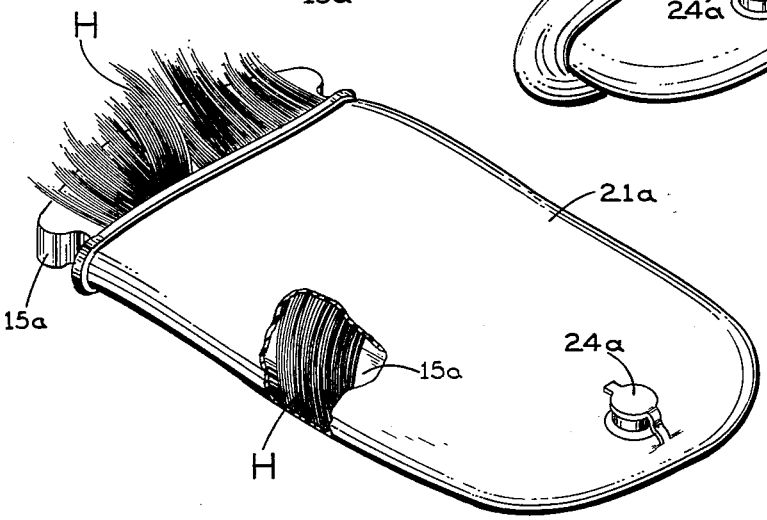
FIG. 9 is a perspective view, partly broken away for clarity, showing the FIG. 8 apparatus applied to the hair and before removal of the core.
Figure 10:
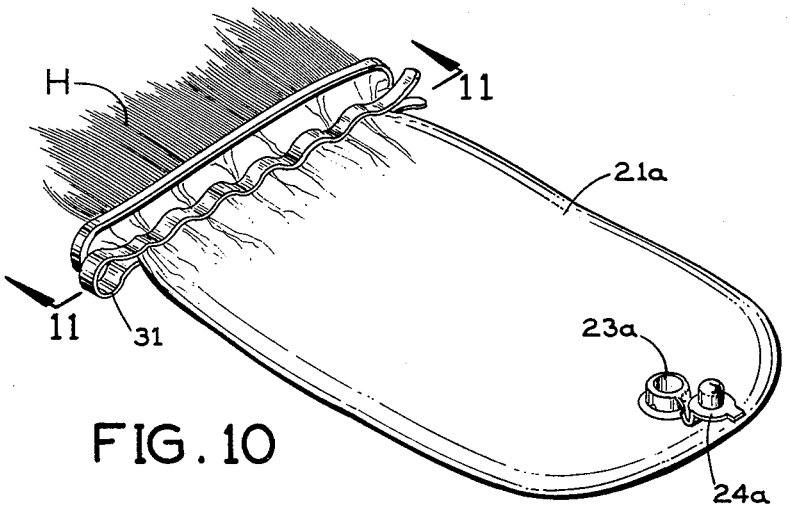
FIG. 10 shows the sheath of the FIG. 8 apparatus clamped to the hair by a bobby pin after the core has been removed.

In FIG. 8, at the opposite end of the core 15*a* from where the hair end-receiving slot 18*a* is located, the top of the core is formed with a roughened segment 30, formed by serrations, corrugations or the like, providing a finger grip segment which makes the core easier to grasp securely even if it is wet by the hair-treating solution.

Instead of flexible ties, the apparatus of FIGS. 8–11 uses a bobby pin 31 to clamp the sheath 21*a* to the strands of hair after the core 15*a* has been slipped out.

Figure 11:
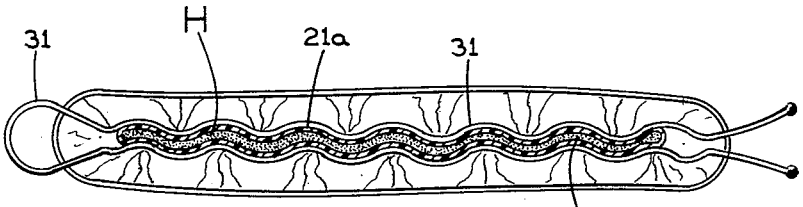
FIG. 11 is a cross-section taken along the line 11—11 in FIG. 10.

With this arrangement, the strands of hair held in the sheath 21*a* are clustered in a bundle having a much greater cross-sectional size in a direction longitudinally of the bobby pin clamp than in a direction perpendicular thereto, as will be evident from FIG. 11. This provides maximum exposure of all the hair strands to the treating solution that is poured into the sheath 21*a* through the opening at 23*a*.

I claim:

1. Apparatus for treating hair comprising:

a core having means at one end for holding the free end of strands of hair to be wrapped around the core;

and a flexible sheath of fluid-tight material which is closed at one end and open at its opposite end, said sheath being slidably insertable over said core with said open end first from said one end of the core toward the opposite end of the core while the wrapped-around strands of hair remain in place on the core;

said core being slidably removable from said open end of the sheath while leaving the strands of hair inside the sheath;

and said sheath having an opening for introducing hair-treating fluid, and a removable closure for said opening.

2. Apparatus according to claim 1, wherein said strand-holding means at said one end of the core is a slot in the core.

3. Apparatus according to claim 2, wherein said slot is open at said one end of the core and extends longitudinally thereof from said one end.

4. Apparatus according to claim 3, wherein said core has a longitudinally extending groove therein adjacent its opposite end for receiving the strands of hair.

5. Apparatus according to claim 1, wherein said core has a transverse finger grip enlargement at its opposite end to be grasped by the user when manipulating the core.

6. Apparatus according to claim 1, wherein said core has a roughened surface at its opposite end to be grasped by the user when manipulating the core.

7. Apparatus according to claim 1, wherein said sheath is of thin elastomeric material which is stretched elastically when applied over the core.

8. Apparatus according to claim 1, and further comprising a flexible web attaching said closure integrally to said sheath.

9. Apparatus according to claim 1, wherein said opening in the sheath is adjacent its closed end.

10. Apparatus according to claim 9, wherein said sheath is of thin elastomeric material, and further comprising a flexible web attaching said closure integrally to said sheath.

11. Apparatus according to claim 10, wherein:

said strand-holding means at said one end of the core is a slot which is open at said one end of the core and extends longitudinally of the core from said one end;

and said core has a longitudinally-extending groove therein adjacent its opposite end for receiving the strands of hair.

12. Apparatus according to claim 1, wherein:

said core has opposite major faces and rounded side edges;

said strand-holding means at said one end of the core is a longitudinal slot which is open at said one end and at said major faces of the core and is located substantially midway between said side edges of the core;

said sheath is of thin elastomeric material;

said opening in the sheath is located adjacent its closed end;

and said closure is integrally connected to said sheath.

13. Apparatus according to claim 12, wherein said core has a longitudinal groove in one of its major faces adjacent its opposite end and terminates at said opposite end in a flattened finger grip segment.

14. Apparatus according to claim 12, wherein said core at its opposite end has a finger grip segment with a roughened surface.

* * * * *